US005317331A

United States Patent [19]

Patty et al.

[11] Patent Number: 5,317,331

[45] Date of Patent: May 31, 1994

[54] SYMBOLOGY DISPLAY METHOD

[75] Inventors: Evelyn J. Patty, Albuquerque, N. Mex.; Jose A. Q. Garza, Tempe, Ariz.

[73] Assignee: Honeywell Inc., Minneapolis, Minn.

[21] Appl. No.: 782,914

[22] Filed: Oct. 25, 1991

Related U.S. Application Data

[63] Continuation of Ser. No. 500,076, Mar. 28, 1990, abandoned.

[51] Int. Cl.[5] ..... G09G 1/10

[52] U.S. Cl. ..... 345/16; 345/13

[58] Field of Search ..... 340/736, 739, 740, 734, 340/741, 742, 737, 738

[56] References Cited

U.S. PATENT DOCUMENTS

| | | | |
|---|---|---|---|
| 4,070,662 | 1/1978 | Narveson | 340/726 |
| 4,511,892 | 4/1985 | Grothe | 340/739 |
| 4,584,574 | 4/1986 | Beausoleil | 340/739 |
| 4,631,532 | 12/1986 | Grothe | 340/739 |
| 4,635,050 | 1/1987 | Grothe et al. | 340/739 |
| 4,882,577 | 11/1989 | DeVore | 340/739 |

*Primary Examiner*—Ulysses Weldon

*Assistant Examiner*—Gin Goon

*Attorney, Agent, or Firm*—Ronald E. Champion

[57] ABSTRACT

In a digital display system including a stroke scanning mechanism, a method which comprises the steps of displaying symbology and increasing or decreasing the number of symbols stroke scanned, including the null symbol depending upon comparisons of actual stroke time to a predetermined stroke time limit. The symbology is initially displayed by stroke scanning. The actual stroke time for stroke scanning the symbology is measured. The actual stroke time is then compared with the predetermined stroke time limit to ascertain whether or not the time limit has been exceeded. If the stroke time limit is not exceeded and a null symbol is not present in the symbology stroke scanned, a null symbol is added. If the stroke time limit is not exceeded and a null symbol is present in the stroke scanned symbology, the number of symbols is increased. If the stroke timing limit is exceeded and a null symbol is present in the symbology stroke scanned, the null symbol is removed. If the stroke time limit is exceeded and the null symbol is not present, a null symbol is added and the number of other visible symbols is decreased.

6 Claims, 6 Drawing Sheets

SYMBOLOGY DISPLAY METHOD

This is a continuation of copending application Ser. No. 500,076, filed on Mar. 28, 1990, now abandoned.

FIELD OF THE INVENTION

The present invention is directed to digital display systems and, more particularly, to a method for eliminating an excess data condition in a digital display system employing stroke scanning of symbols wherein a null symbol is employed to eliminate flickering of the display.

BACKGROUND OF THE INVENTION

In a digital display system, such as a digital map system in an avionic cockpit environment, symbols representing aeronautical data, such as waypoints, are usually overlayed over an aeronautical chart or other display background. FIG. shows a typical cockpit display 10 including symbols 12, 14 and 16. Such displays, including the symbology, are typically generated from data received from an onboard computer such as a digital map computer, for example. Such display systems must meet stringent requirements, such as updating the display up to 60 times per second, and this leads to limitations on the number of symbols which can be displayed at any given point in time. If such a system attempts to display too many symbols simultaneously, an excess data condition can arise which results in dimming and ultimately flickering of the display. This is because prior display systems did not have the capability to reduce symbology when an excess data condition existed. Such prior art display systems extended the stroke time to accommodate all symbols rather than adaptively limiting the number of symbols to fit a fixed stroke time. Stroke time is defined as the time it takes to accomplish stroke scanning of all the symbols. Current display systems have fixed refresh period requirements which allow only a limited stroke time period between refresh cycles. In prior art systems which had non-fixed stroke times, when more stroke time was used to accommodate an increasing number of symbols, a longer refresh period resulted. The longer refresh period lead to flickering and dimming of the overall display as viewed by a human observer.

SUMMARY OF THE INVENTION

The invention overcomes the perceived disadvantages of the prior art by providing a method in one aspect of the invention whereby a non-visual null symbol is introduced and displayed, which is equivalent to stroke scanning as known in the art, to prevent flashing when removing symbols to eliminate an excess data condition. A null symbol is a symbol which actually generates no visual display, that is, nothing appears on the screen when generating the null symbol because the beam is turned off. However, the null symbol does consume stroke time. The method of the invention is employed in a digital display system including a stroke scanning mechanism and comprises the steps of displaying symbology and stroke scanning a null symbol, and increasing or decreasing both the number of symbols displayed and the number of symbols stroke scanned, depending upon comparisons of actual stroke time to a predetermined stroke time limit. The symbology is initially displayed by stroke scanning. The actual stroke time for displaying the symbology and stroke scanning the null symbol is measured. The actual stroke time is then compared with the predetermined stroke time limit to ascertain whether or not the time limit has been exceeded. If the stroke time limit is not exceeded and a null symbol is not stroke scanned, a null symbol is added. If the stroke time limit is not exceeded and a null symbol is stroke scanned, the number of symbols is increased. If the stroke timing limit is exceeded and a null symbol is stroke scanned, the null symbol is removed. If the stroke, time limit is exceeded and the null symbol is stroke scanned, a null symbol is added and the number of other visible symbols is decreased. The aforedescribed steps are repeated in a cyclical manner as long as the display is operating.

In another aspect of the invention, a null symbol is always present and included in the symbology stroke scanned. In this aspect of the invention, a first stroke time period is measured wherein the first time period occurs before stroke scanning the null symbol and a second time period is measured after stroke scanning the null symbol and including the time in which it takes to stroke scan the null symbol. If the stroke time is exceeded before the null symbol is stroke scanned, the number of other symbols is decreased. If the stroke time is not exceeded before the null symbol is stroke scanned, the second time period is tested to determine whether the stroke time limit is exceeded after stroke scanning the null symbol. If the second time period exceeds the stroke time limit, all symbols are retained including the null symbol and the process recycles. If the second measured time period does not exceed the stroke time limit, the number of symbols is increased according to predetermined priorities and the symbology is, again, stroke scanned repeating the aforedescribed cycle.

It is one object of the invention to provide an adaptive symbology hysteresis method which prevents flashing of a symbol when used in the prioritized display symbology scheme.

It is yet another object of the invention to prevent partial display of a symbol in the process of display at the termination of a minimum or fixed refresh period.

It is yet another object of the invention to provide an adaptive symbology hysteresis method which dynamically limits the number of symbols displayed in order to maintain adherence to a fixed refresh period.

It is yet another object of the invention to provide a method for eliminating an excess data condition whereby dimming and flickering of a cockpit display is avoided.

It is another object of the invention to provide a method to avoid flashing of symbology in a digital display system through the employment of a null symbol.

It is yet another object of the invention to provide a method which dynamically manages the number of symbols to maintain a minimum or fixed refresh period used in conjunction with a prioritized display symbology scheme.

Other objects, features and advantages of the present invention will become apparent to those skilled in the art through the Description of the Preferred Embodiment, claims, and drawings herein wherein like numerals refer to like elements.

DESCRIPTION OF THE PREFERRED EMBODIMENT

Figure 1:
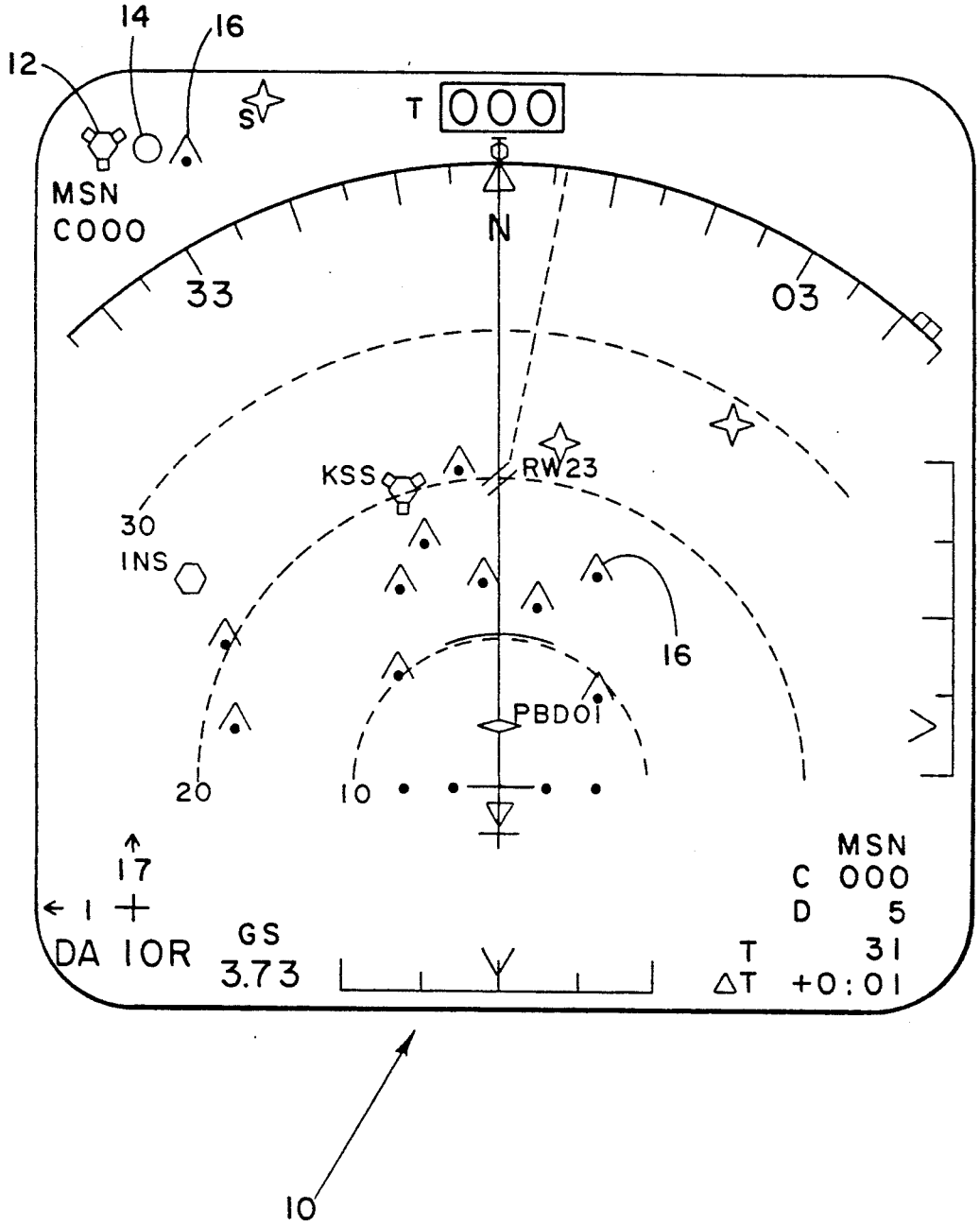
FIG. 1 shows an example of an avionics cockpit display wherein the method of the invention is employed.
Figure 2:
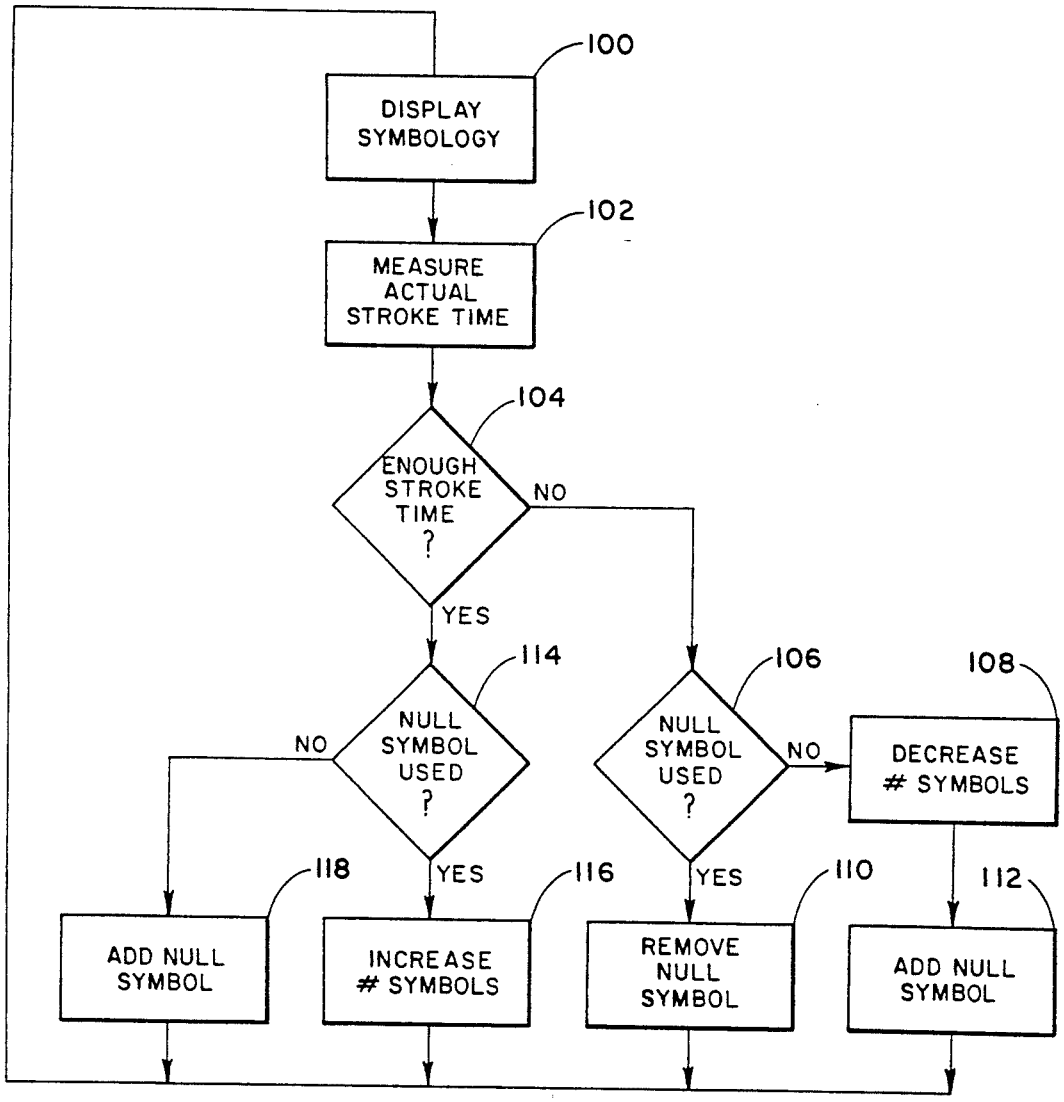
FIG. 2 shows a flow chart which details the major steps of one aspect of the method of the invention.

Referring now to FIG. 2, a flow chart of the major steps of one aspect of the invention is shown wherein adaptive symbology hysteresis is employed to dynamically manage the number of symbols displayed on a digital map system. The process of the invention maintains a minimum or fixed refresh period in conjunction with a prioritized display symbology scheme. The prioritized symbology scheme is provided in accordance with well-known methods. Various symbols such as the symbols shown in FIG. 1 including waypoints 16, are prioritized in accordance with user defined requirements prior to being displayed. At step 100, a predetermined number of a plurality of such symbols are displayed. The symbols are displayed typically through stroke scanning in a well known manner.

In a typical digital display system employing the method of the invention, the stroke scanning of the symbols displayed must be accomplished within a given predetermined refresh period. The refresh period may be on the order of 60 times per second. Therefore, an upper limit on the stroke time must be maintained in order to maximize the number of symbols displayed while avoiding flashing of symbols to the human eye. Initially, the system may try to display all of the symbols available or only a predetermined number of initial symbols at step 100. At step 102, the actual stroke time, that is the time it takes to actually stroke scan all of the displayed symbols and null symbols, is measured. At step 104, a determination is made as to whether or not there was enough stroke time to complete stroke scanning of all of the symbols in the previous step. That is, a determination is made as to whether or not the actual stroke time exceeds the predetermined stroke time limit which, in turn, is determined from the refresh period required. An alternative embodiment is, at step 102, to determine if all of the symbols were stroke scanned during the minimum or fixed refresh period. If the stroke time limit has been exceeded or, in the alternative embodiment, all symbols were not stroke scanned, the method of the invention proceeds to step 106. If the stroke time limit has not been exceeded, the method of the invention proceeds to step 114. Assuming the branch to step 106 is taken, the stroke scanned symbology is tested for the presence of a null symbol. If a null symbol was not stroke scanned with the displayed symbology the method proceeds to step 108. If the null symbol was stroke scanned with the displayed technology, the method of the invention proceeds to step 110. At step 108, the number of symbols is decreased and the method proceeds to step 112 wherein the null symbol is added. The method then cycles back to step 100 and repeats. If the null symbol was not used, the method proceeds to step 11 where the null symbol is removed and the method cycles back to step 100

If at step 104, the stroke time limit was not exceeded, the method proceeds to step 114 wherein the presence of the null symbol is determined in a manner similar to that described with reference to step 106 above. If the null symbol was used, the method proceeds to step 116 wherein the number of displayed symbols is increased. If the null symbol was not used, the null symbol is added at step 118. The cycle then resumes with step 100 until the display is terminated.

Figure 3A:
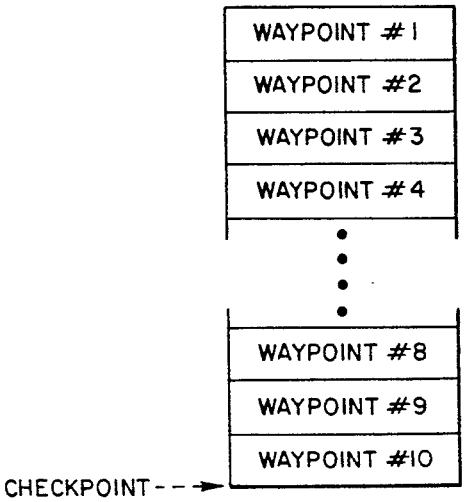
FIGS. 3A and 3B illustrate an example application of one aspect of the invention wherein hysteresis is used.
Figure 3B:
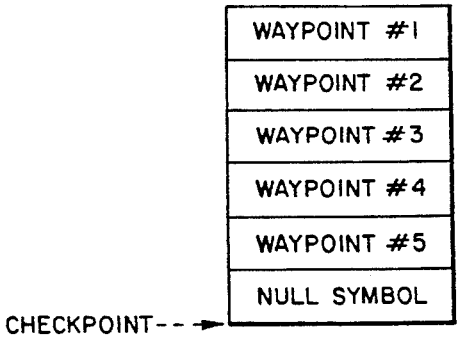

Referring now to FIGS. 3A and 3B an illustrative example of the method of the invention is presented. FIG. 3A shows a prioritized series of waypoints numbered 1–10. The checkpoint indicated occurs at the end of the displayed available symbols. The symbols displayed as illustrated in FIG. 3A do not include a null symbol. If it is assumed that the stroke limit is reached after displaying six symbols, the time period required for stroke scan display of waypoint symbols number 1–10 would exceed the stroke time limit. Referring again to FIG. 2, the example shown in FIG. 3A would result in exiting step 104 at the "no" branch following that branch into step 106 and exiting step 106 at its "no" branch to step 108. Therefore, the number of symbols would be decreased and the null symbol would be added given the conditions shown in FIG. 3A.

Referring now to FIG. 3B with continuing reference to FIG. 2, a second set of conditions exemplifying another aspect of the logic shown in FIG. 2 is shown. Again, assuming that the stroke limit is exceeded after six or more symbols are displayed, the actual stroke scan time period measured at the checkpoint in FIG. 3B which occurs after stroke scanning the null symbol would result in the stroke limit not being exceeded at the checkpoint. Correlating this example to FIG. 2, after the symbology, namely waypoints 1–5 and the null symbol are stroke scanned in step 100 and the actual stroke time is measured in step 102 as explained above. The inquiry at step 104 will, in this case, result in a "yes" branch to step 114. Since the null symbol is used in this example, step 114 will branch on the "yes" branch to step 116 and the number of symbols will be increased before returning to step 100.

Figure 4A:
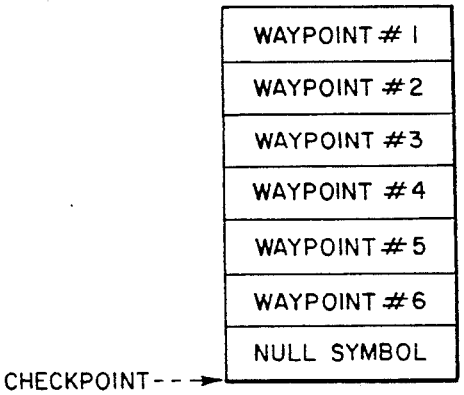
FIGS. 4A and 4B illustrate an example of an application of a hysteresis equilibrium state as employed in one aspect of the method of the invention.
Figure 4B:
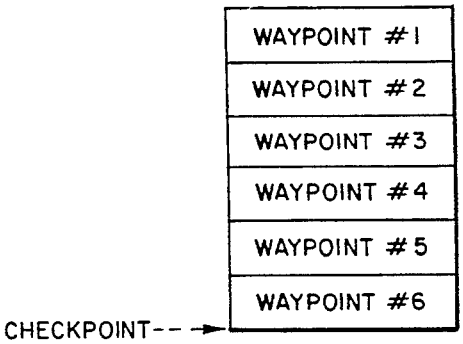

FIGS. 4A and 4B illustrate some other possible conditions which may exist in the system and illustrate branches to other parts of the decision logic provided by the method of the invention. Referring to FIG. 4A with continuing reference to FIG. 2 and assuming for illustrative purposes that the stroke limit is exceeded after displaying six symbols, the stroke time limit will be exceeded at the checkpoint occurring after stroke scanning the null symbol. Following the flow shown in FIG. 2, this will result in branching through step 106 to step 110 wherein the null . symbol is removed. The next time through the loop the condition shown in FIG. 4B will exist wherein the null symbol has been removed and the measurement of actual stroke time at the checkpoint in FIG. 4B will result in a decision at step 104 that the stroke time has not been exceeded, thereby causing the process to branch to step 114. Since the null symbol is not used in step 114, it will be added at step 118. Note that this will then result again in a configuration shown in FIG. 4A wherein the six waypoints and a null symbol are input into the display symbology step 100. In this way, an equilibrium state is reached wherein the null symbol is alternately added and removed from the symbology stroke scanned, thereby maintaining the screen at an equilibrium state wherein six waypoints are continually displayed without causing any of the waypoint symbols to flash on the display screen.

Figure 5:
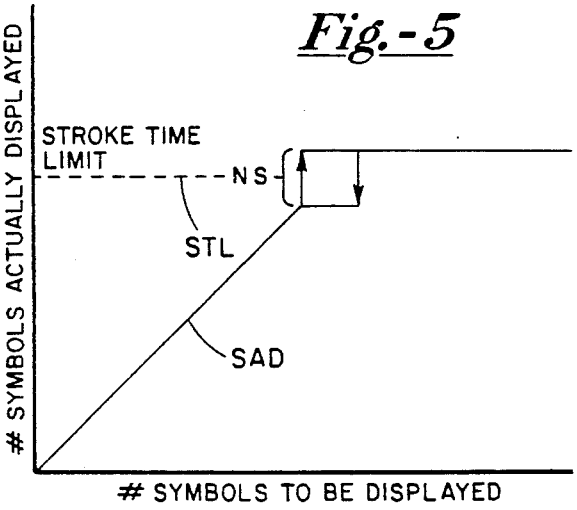
FIG. 5 is a graphical representation of the null symbol hysteresis scheme of the invention.

FIG. 5 shows a graphical illustration of the principles employed by the method of the invention in the first aspect of the invention. As can be seen in FIG. 5, the number of symbols actually stroke scanned is illustrated on the vertical axis while the number of symbols to be stroke scanned defines the horizontal axis. The stroke time limit is indicated as broken line STL. The null symbol hysteresis is represented by loop NS. Line SAD is a plot of the number of symbols actually stroke scanned versus the number of symbols available for stroke scanning. Note that as the stroke time limit is reached, the null signal loop prevents display of actual symbols which would exceed the stroke time limit.

Figure 6A:
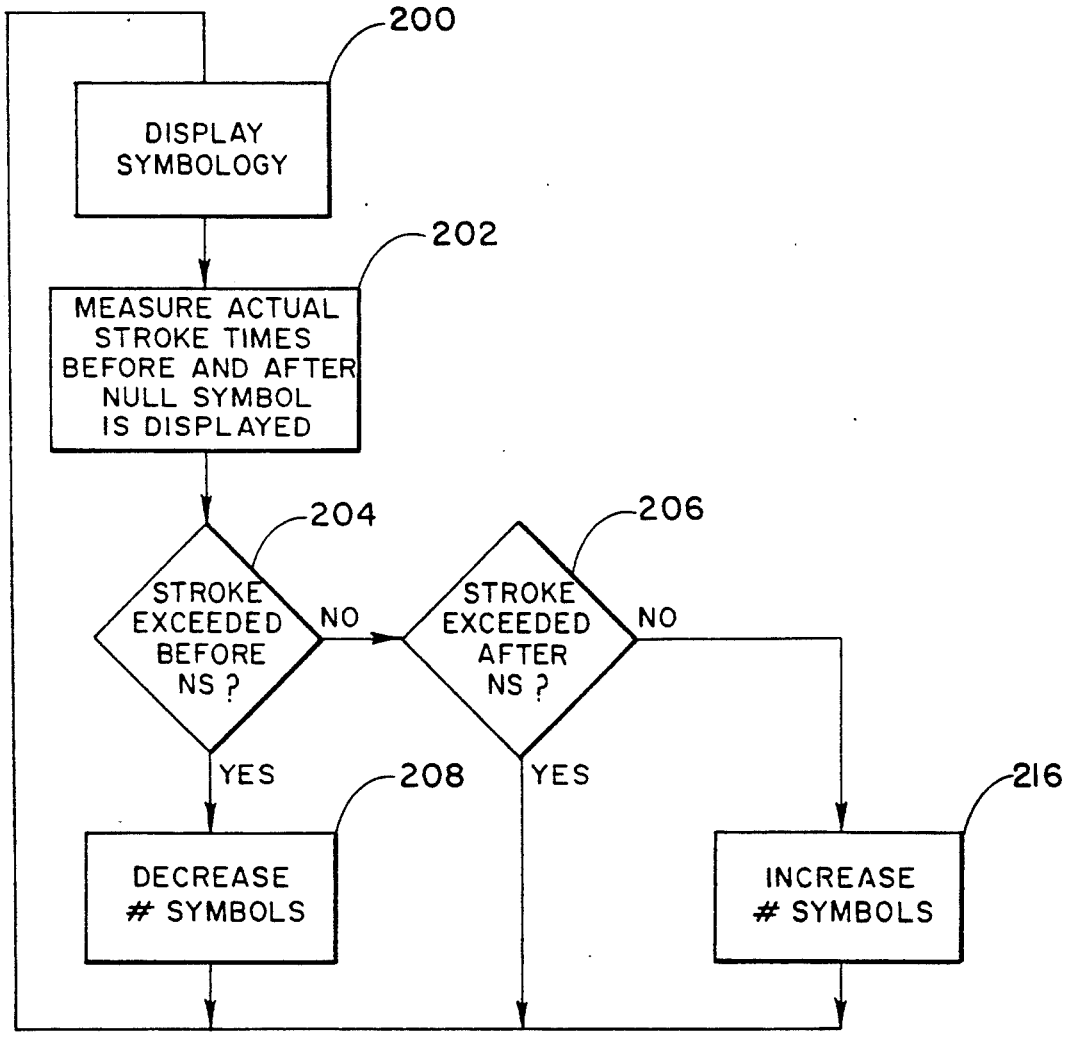
FIGS. 6A and 6B are flow charts of other aspects of the invention using a non-hysteresis scheme wherein a null symbol is always present.

Referring now to FIG. 6A, another aspect of the invention is shown wherein a null symbol is always present and wherein the hysteresis loop is not employed. At step 200, symbology is stroke scanned always including a null symbol as part of the symbols stroke 500. At step 202, the process measures the actual stroke times before and after the null symbol is stroke scanned resulting in first and second measured actual time periods. The process then continues to step 204 wherein the first time period measured from the time of the start of the display to the time just before stroke scanning the null symbol is compared with the stroke time limit. If the stroke time limit is exceeded at step 204, the process continues to step 208 and the number of actual symbols is decreased while retaining the null symbol. If the stroke time limit is not exceeded by the first time period, the process continues to step 206 wherein the second time period, which includes the first time period added to the time for stroke scanning the null symbol, is compared against the stroke time limit. If the stroke time limit is exceeded by the second measured time period, the process branches back to step 200 and the number of symbols is not changed. If the stroke limit has not been exceeded after the null symbol is stroke scanned, the "no" branch of step 206 is followed to step 216 and the number of symbols is increased by a predetermined number of increments. The process then cycles as long as necessary to display the symbology.

Figure 6B:
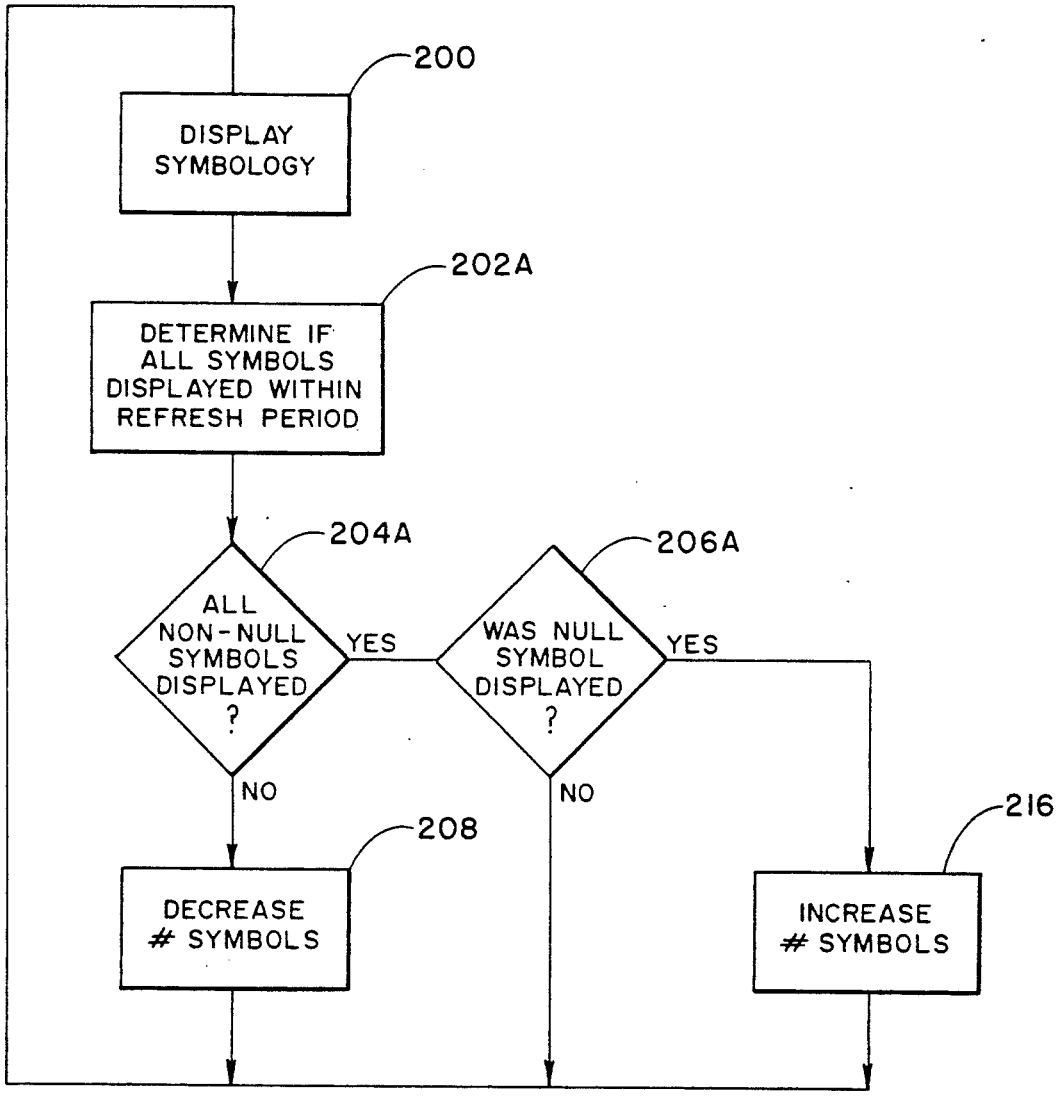

Referring now to FIG. 6B, another aspect of the invention is shown wherein a null symbol is always present and wherein the hysteresis loop is not employed for fixed refresh period applications. At step 200, symbology is stroke scanned always including a null symbol as part of the symbols stroke scanned. At step 202A, the process determines if all of the non-null symbols were displayed and if the null symbol was stroke scanned during the minimum or fixed refresh period. The process continues to step 204A wherein the stroke time limit is considered to be exceeded if all non-null symbols were not displayed. If all non-null symbols were not displayed, the process continues to step 208 and the number of actual symbols is decreased while retaining the null symbol. If all non-null symbols were displayed, the process continues to step 206A wherein the stroke time limit is considered to be exceeded if the null symbol was not stroke scanned. If the null symbol was not stroke scanned, the process branches back to step 200 and the number of symbols is not changed. If the null symbol was stroke scanned, the "yes" branch of step 206A is followed to step 216 and the number of symbols is increased by a predetermined number of increments. The process then cycles as long as necessary to display the symbology.

Figure 7A:
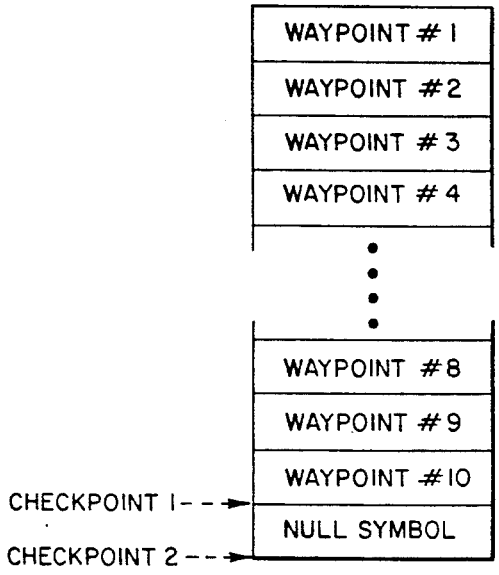
FIGS. 7A and 7B illustrate an example of an application using the non-hysteresis symbology method employed in an alternative aspect of the invention as illustrated in FIG. 6A.
Figure 7B:
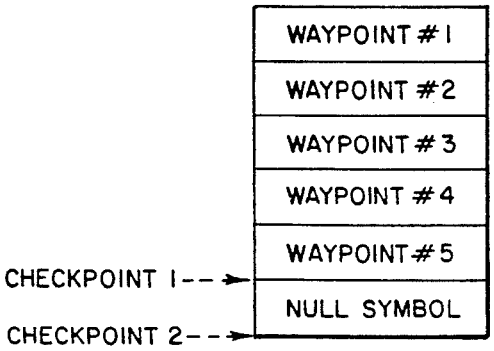
Figure 8:
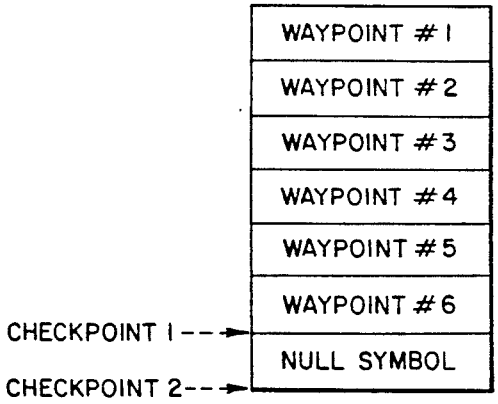
FIG. 8 illustrates the equilibrium state of the alternative aspect of the invention.

FIGS. 7A, 7B and 8 show various examples illustrating the non-hysteresis symbology decrease, increase and equilibrium states of an alternate aspect of the invention. Referring to FIG. 7A, with continuing reference to FIG. 6A, a set of waypoints 1-10 and a null symbol is shown as available for stroke scanning at step 200. Checkpoint number 1 wherein a first time period is measured from waypoint number 1 through waypoint number 10 occurs immediately after the display of waypoint number 10 and immediately before the stroke scanning of the null symbol. Checkpoint number 2 is the point at which a second measurement is taken for a second time period which is inclusive of the time period measured in checkpoint number 1 plus the time period required to stroke scan the null symbol. In this example, assuming for illustrative purposes that the stroke limit is exceeded after the display of six or more symbols, the stroke limit will be exceeded at checkpoint number 1 and at checkpoint number 2. Following the logic flow shown in FIG. 6, the process will branch through step 208 and the number of symbols will be decreased.

Now referring to FIG. 7B, another illustrative example is shown wherein six symbols, including the null symbol, are available for stroke scanning at step 200. In this case, assuming the stroke limit allows for six symbols to be displayed, the stroke limit is not exceeded at either checkpoint number 1 or checkpoint number 2. Therefore, referring again to FIG. 6A, the process will branch through step 216 and the number of symbols will be increased by adding a waypoint number 6, for example.

Referring now to FIG. 8, the non-hysteresis equilibrium state of the second aspect of the invention shown in FIG. 6 is illustrated. FIG. 8 shows the number of symbols available for display resulting from the processing of the example shown in FIG. 7B as described above. Namely, the sixth waypoint has been added between waypoint number 5 and the null symbol. At this point, the stroke limit will be exceeded at checkpoint number 2 but not at checkpoint number 1. This will result in an equilibrium being reached whereby the process flow shown in FIG. 6A will proceed through step 206 to the "yes" branch of 206 and the number of symbols will neither be increased nor decreased. The fact that the null symbol occurs after exceeding the time limit for stroke scanning is of no consequence on the display since the null symbol results in no visible display.

This invention has been described herein in considerable detail in order to comply with the Patent Statutes and to provide those skilled in the art with the information needed to apply the novel principles as required. However, it is to be understood that the invention can be carried out by specifically different methods and that various modifications as to operating procedures can be accomplished without departing from the scope of the invention itself. For example, while the above descriptive examples show increasing or decreasing the number of waypoints in one waypoint increments, some applications may vary by and use a higher number of incremental waypoints or other symbols.

What is claimed is:

1. A method for truncating excess data in a digital display system having a fixed refresh rate by employing a null symbol as a gauge, the method comprising the steps of:

(a) stroke scanning a set of symbology comprising visual symbols while marking actual stroke time of the set of symbology;

(b) comparing the actual stroke time of the set of symbology with a predetermined stroke time limit;

(c) if the actual stroke time does not exceed the predetermined stroke time limit and a null symbol is not present in the set of symbology, adding a null symbol to the set of symbology;

(d) if the actual stroke time exceeds the predetermined stroke time limit and a null symbol is present in the set of symbology, removing the null symbol from the set of symbology;

(e) if the actual stroke time exceeds the predetermined stroke time limit and a null symbol is not present in the set of symbology, removing at least one of the visual symbols from the set of symbology and adding a null symbol to the set of symbology;

(f) if the actual stroke time does not exceed the predetermined stroke time limit and a null symbol is present in the set of symbology, adding a visual symbol to the set of symbology; and (g) repeating steps (a) through (f).

2. The method of claim 1 wherein the displayed symbology comprises aeronautical chart symbols, including waypoints.

3. A method for truncating excess data in a digital display system requiring display refresh and employing a null symbol as a gauge wherein stroke time is used in stroke scanning the nonvisual null symbol and wherein a predetermined stroke time limit is imposed, the method comprising the steps of:

(a) stroke scanning a set of symbology comprising visual symbols and a null symbol and marking the actual stroke time of the set of symbology;

(b) measuring a first stroke time period within the marked actual stroke time for stroke scanning the visual symbols of the set of symbology;

(c) comparing the first stroke time period with the predetermined stroke time limit;

(d) if the first stroke time period exceeds the predetermined stroke limit, removing a visual symbol and recycling to step (a);

(e) measuring a second stroke time period, within the marked actual stroke time for stroke scanning the set of symbology, including any stroke time required for stroke scanning any null symbol in the set of symbology;

(f) comparing the second stroke time period with the predetermined stroke time limit;

(g) if the second stroke time period does not exceed the stroke time limit, adding a visual symbol to the set of symbology and recycling to step (a); and (h) if the second stroke time period exceeds the stroke time limit, recycling to step (a).

4. The method of claim 3 wherein the stroke time limit is determined in accordance with the display refresh.

5. A method for truncating excess data within a digital display system having display refresh and having a predetermined fixed refresh period, the method employing a null symbol as a gauge and using stroke time in stroke scanning the null symbol, the method comprising the steps of:

(a) stroke scanning a set of symbology comprising visual symbols and the null symbol within the predetermined fixed refresh period;

(b) determining whether all the visual symbols and the null symbol in the set of symbology were stroke scanned during the predetermined fixed refresh period;

(c) if all the visual symbols in the set of symbology were not stroke scanned during the fixed refresh period, removing a visual symbol from the set of symbology;

(d) if all visual symbols and a null symbol in the set of symbology were stroke scanned during the fixed refresh period, adding a visual symbol to the set of symbology; and (e) recycling to step (a).

6. The method of claim 5 wherein the available visual symbology comprises aeronautical chart symbols including waypoints.

* * * * *